US005770249A

United States Patent [19]

Mello et al.

[11] Patent Number: 5,770,249

[45] Date of Patent: Jun. 23, 1998

[54] MEAT PRODUCT PACKAGE AND METHOD OF FORMING SAME

[75] Inventors: Frank C. Mello, Columbus, Miss.; Jeffrey A. Williams, Calhoun, Ga.; Roger S. Williams, New Richmond, Ohio

[73] Assignee: Sara Lee Corporation, Winston-Salem, N.C.

[21] Appl. No.: 707,630

[22] Filed: Sep. 5, 1996

Related U.S. Application Data

[63] Continuation of Ser. No. 489,390, Jun. 12, 1995, abandoned.

[51] Int. Cl.[6] ..... B65D 85/08; B65B 25/06

[52] U.S. Cl. ..... 426/119; 426/129; 426/392; 53/428; 53/429; 206/471; 206/563; 206/564

[58] Field of Search ..... 426/129, 119, 426/392; 206/564, 563, 443, 471, 526, 363, 446; 53/428, 429; D9/345

[56] References Cited

U.S. PATENT DOCUMENTS

| | | | |
|---|---|---|---|
| 2,379,934 | 7/1945 | Seiferth | 206/443 |
| 2,903,139 | 9/1959 | Penman | D9/345 |
| 3,216,832 | 11/1965 | King | 426/414 |
| 3,464,618 | 9/1969 | Martelli et al. | D9/345 |
| 3,615,716 | 10/1971 | Poulos | 426/119 |
| 3,676,159 | 7/1972 | Fallowfield | 426/129 |
| 3,792,181 | 2/1974 | Mahaffy et al. | 426/129 |
| 3,839,841 | 10/1974 | Amplatz | 53/429 |
| 3,903,309 | 9/1975 | Mahaffy et al. | 426/129 |
| 4,158,408 | 6/1979 | Thiessen | 426/119 |
| 4,232,787 | 11/1980 | Holiday | 206/443 |
| 4,458,468 | 7/1984 | Sivilich | 53/428 |
| 4,522,301 | 6/1985 | Ajmera | 426/119 |
| 4,958,735 | 9/1990 | Odabaashian | 206/471 |
| 5,005,703 | 4/1991 | Brodker | 206/563 |
| 5,199,567 | 4/1993 | Discko | 206/564 |
| 5,353,929 | 10/1994 | Foster | 206/564 |

FOREIGN PATENT DOCUMENTS

| | | | |
|---|---|---|---|
| 482589 | 1/1970 | Switzerland | 426/119 |
| 2134490 | 8/1984 | United Kingdom | 206/363 |

*Primary Examiner*—Steven Weinstein
*Attorney, Agent, or Firm*—Charles Y. Lackey; Kilpatrick Stockton LLP

[57] ABSTRACT

A meat product package for storing and displaying a plurality of tubular meat products, preferably in an arcuate configuration, having a meat product forming station with plural arcuate recesses utilizing overformed recess edges to hold the tubular meat products in a curved position within the recesses for storage and display.

17 Claims, 2 Drawing Sheets

MEAT PRODUCT PACKAGE AND METHOD OF FORMING SAME

BACKGROUND OF THE INVENTION

This application is a continuation application of my previously filed application Ser. No. 08/489,390, filed Jun. 12, 1995, and entitled MEAT PRODUCT PACKAGE, now abandoned.

1. Field of the Invention

The present invention relates generally to meat product packages and more particularly to a meat product package having a plurality of arcuate recesses fashioned to retain a plurality of tubular meat products in an arcuate and natural configuration.

2. Description of the Prior Art

Tubular meat product casings made from natural intestines normally contain the natural curve of the casing after the packaging process. This "old world" configuration was accepted and well-known and still suggests processing in that early natural way practiced many years ago in the meat industry, particularly in Europe. There is an inherent marketplace attraction to this package appearance, and such appearance is notably absent from the majority of packages used in the current market.

Conventional tubular meat product packages deal with various ways of efficiently and securely packaging substantially straight or linear tubular meat products. More attention is given to package sealing and product preservation once the package has been opened, and product accessibility as it is being used over a period of time. Virtually no tubular product package captures the "old world" or traditional natural curve arising from the use of cattle, hog or sheep gut intestine lining that generally conform to the curve set when it resided in the animal while it was alive. There is a consumer attraction to that natural curve, and the present invention is developed to meet that consumer attraction.

OBJECTIVES AND SUMMARY OF THE PRESENT INVENTION

The primary objective of the present invention is to develop a tubular meat product package that will retain and display tubular meat products such as sausages, smoked kielbasa, bratwurst, and the like in a manner that will display to the consumer a natural curve earlier experienced from the use of cattle, hog or sheep gut intestines.

Another objective of the present invention is to develop a tubular meat product package utilizing overformed edges to maintain the tubular meat products in a pre-selected arcuate condition.

Yet another object of the present invention is to develop a meat product package of the type described that can store and display from 2 to 12 tubular meat products in various lengths and diameters and through a range of angular arches.

The present invention is a meat product package having a plurality of recesses for receiving a plurality of tubular meat products. Each recess has a bottom portion, side portions, and end portions, some of which have overformed edges to hold the tubular meat products within the recess and in the desired arcuate condition for storage and display.

The objectives set forth above and other objectives and advantages of the present invention will become more apparent after consideration of the following detailed description taken in conjunction with the accompanying drawings wherein like characters of reference designate like parts throughout the several views.

DESCRIPTION OF THE PREFERRED EMBODIMENT

Figure 1:
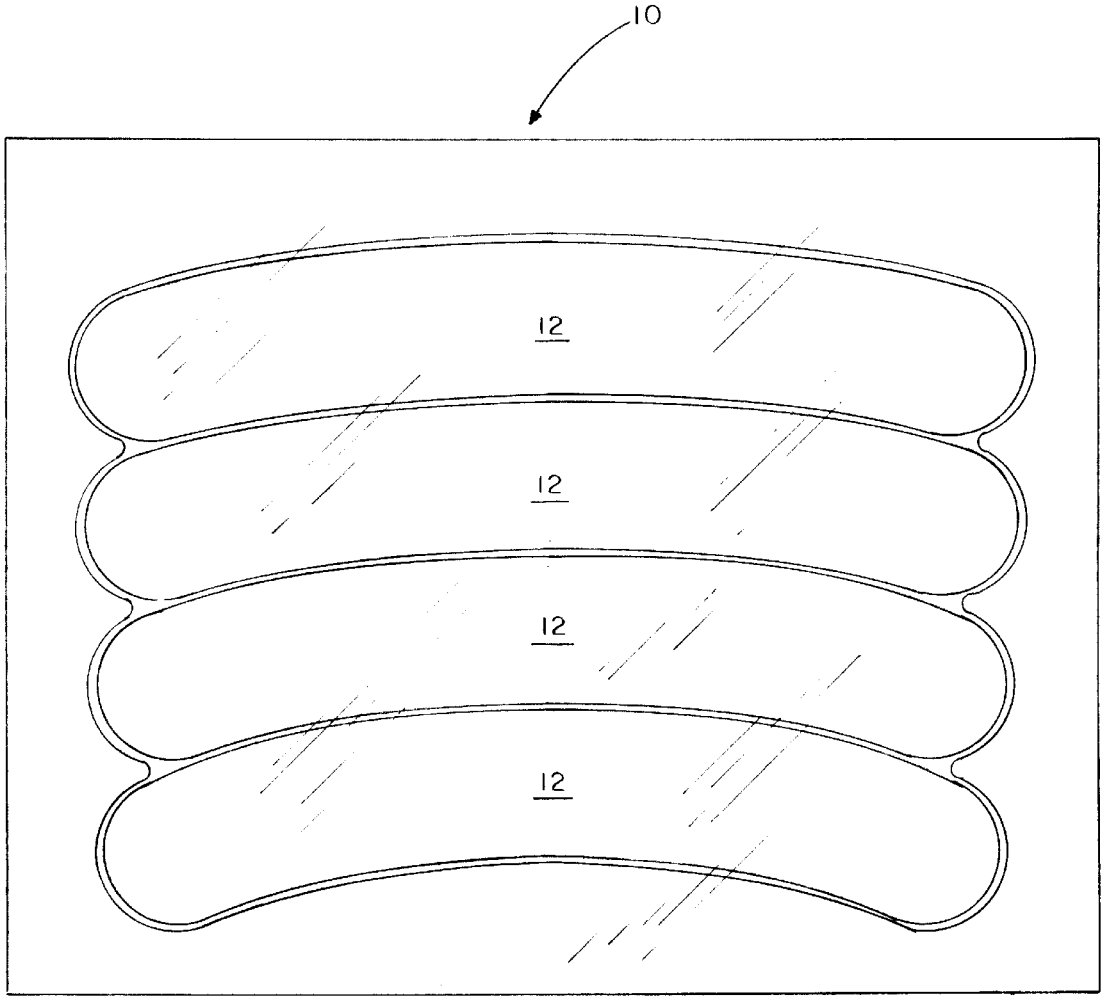
FIG. 1 is a plan view of the food product package comprising the present invention illustrating the utilization of 4 recesses to store and display 4 tubular meat products.

Referring now to the drawings and particularly to FIG. 1, a meat product package shown generally as 10 is shown in this embodiment to accommodate 4 tubular meat products in an "old world" natural arcuate condition. The package is fabricated to retain the tubular meat products 12 in a curved configuration thus simulating "old world" sausage or similar products. A plurality of recesses 14 which may range in number from 2 to 12 are formed in a forming area or tray, shown generally as 16 in a manner to retain the meat products in a curved position so that they will not escape.

Maintaining the tubular meat products in the curved or natural condition is achieved by overforming the edges 18 of recesses 14 at least along the side portions 20 and even when desired along the end portions 22.

Figure 2:
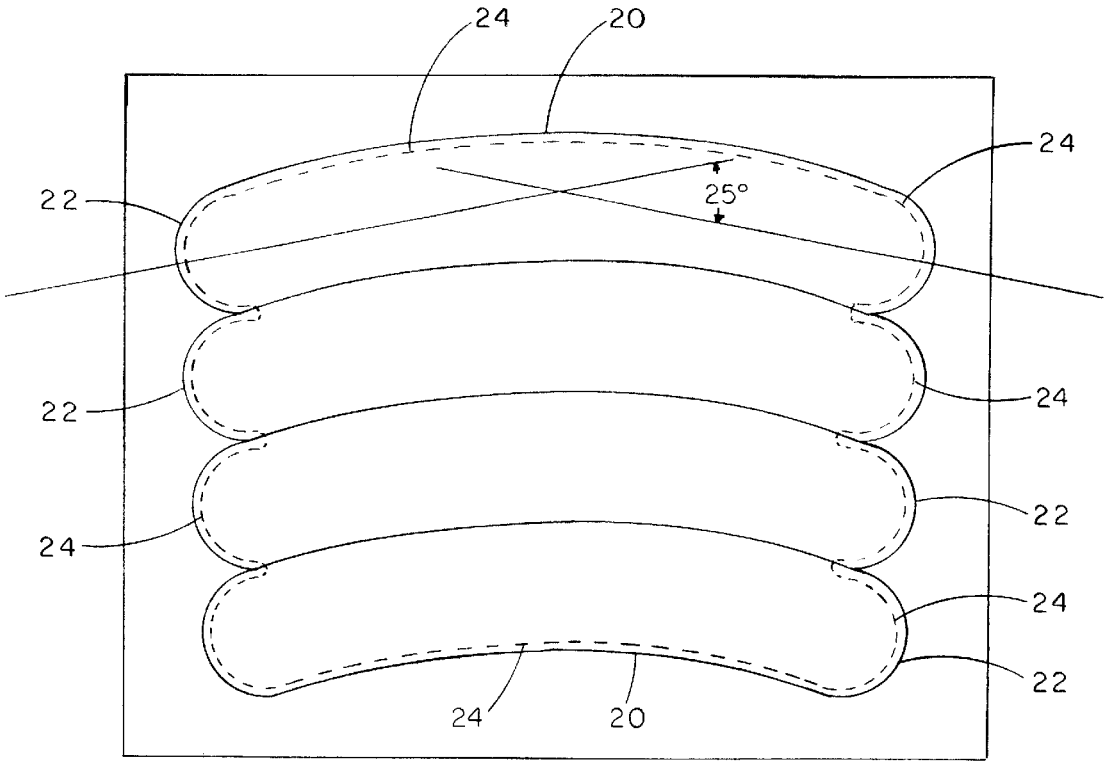
FIG. 2 is a plan view of the meat product package shown in FIG. 1 wherein the tubular meat product location is shown in hidden lines to emphasize the overformed edges of each recess.
Figure 3:
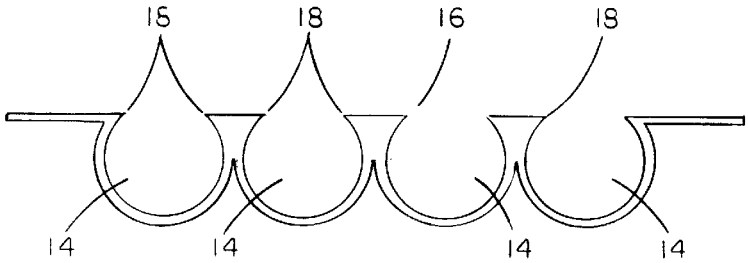
FIG. 3 is a side elevational, partial view of the meat product package shown in FIG. 1 illustrating the overformed side edges utilized to hold the tubular meat products within the recesses for storage and display.

Dotted line 24 in FIG. 2 represents the top or overformed edge of the package while the tubular meat product 12 extends to the sides 20 and ends 22, thus resulting in a retention of the meat product within the recess because of the overformed edges.

The product may be positioned into the recesses either manually or by appropriate mechanical means. Obviously the arch of the desired curve can be within a rather wide range (25 degrees in FIG. 2), most practically between 0 degrees and 180 degrees. The important feature in developing an acceptable angular arch is to make certain that the meat product will not break when bent to the required angular arch.

Figure 4:
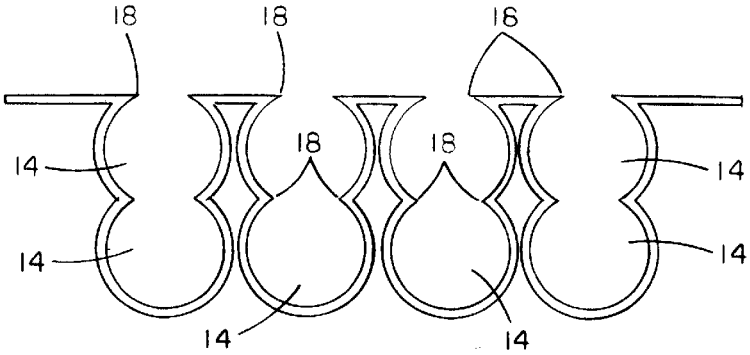
FIG. 4 is a side elevational, partial view of the meat product package having plural stacked recesses with overformed side edges for holding tubular meat products.

The package comprising the present invention is suitable for use with a variety of meat products including sausage, kielbasa, frankfurters, and other such items which may be processed with "skinless" or other artificial casings. These types of casings (cellulose, collagen, etc.) generally do not result in a product having a natural curvature. Moreover, the forming area may contain stacked recesses up to 4 layers of tubular meat products in addition to a variety of planar meat products within a range of from 2 to 12. FIG. 4 illustrates an example of this stacked concept.

The package comprising the present invention may vary in size to store and display tubular meat products from ¼ inch to 1½ inches in diameter, and from 3 to 12 inches in length.

It is to be realized that the optimum dimensional relationship for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed herein.

The foregoing is considered as illustrative only of the principals of the invention. Since numerous modifications and changes will readily occur to those skilled in the art, it is intended not to limit the invention to the exact construction and operation shown and described. All suitable modifications and equivalents that fall within the scope of the appended claims are deemed within the present inventive concept.

What is claimed is:

1. A meat product package for displaying in an arcuate arrangement a plurality of elongated, free ended, sausage shaped meat products which have been processed prior to packaging such that the meat products normally maintain a substantially straight shape said package comprising: a tray and a plurality of said elongated, free ended, sausage-shaped, processed meat products, each meat product having a longitudinal axis, the tray having a plurality of elongated recesses with each recess containing one of said products, each recess having a longitudinal arcuate configuration and each recess being suitably sized to receive the normally substantially straight meat product therein after it has been bent and to hold the normally substantially straight meat product in the arcuate configuration of the recess under tension, each recess having a bottom portion, side portions and end portions, the bottom and side portions extending substantially parallel to the product longitudinal axis, and the side and end portions having overformed edges, said overformed edges extending along the arcuate configuration of the recess to maintain the sausage-shaped meat product in the arcuate configuration under tension within the recess for storage and display.

2. The package as claimed in claim 1 wherein each recess is sufficient in size to retain said sausage shaped meat product up to 12 inches in length.

3. The package as claimed in claim 2 wherein each recess is sufficient in size to retain the sausage shaped meat product up to 1½ inches in diameter.

4. The package as claimed in claim 2 wherein each recess has a substantially circular cross-section.

5. The package as claimed in claim 2 wherein each recess is arched in a range up to 180 degrees.

6. The package as claimed in claim 1 wherein each recess is sufficient in size to retain the sausage shaped meat product up to 1½ inches in diameter.

7. The package as claimed in claim 6 wherein each recess has a substantially circular cross-section.

8. The package as claimed in claim 6 wherein each recess is arched in a range up to 180 degrees.

9. The package as claimed in claim 6 wherein the number of recesses in the tray are within a range of from 2 to 12.

10. The package as claimed in claim 1 wherein each recess has a substantially circular cross-section.

11. The package as claimed in claim 10 wherein each recess is arched in a range up to 180 degrees.

12. The package as claimed in claim 11 wherein the number of recesses in the tray are within a range of from 2 to 12.

13. The package as claimed in claim 10 wherein the number of recesses in the tray are within the range of from 2 to 12.

14. The package as claimed in claim 1 wherein each recess is arched and arranged up to 180 degrees.

15. The package as claimed in claim 14 wherein the number of recesses in the tray are within a range of from 2 to 12.

16. The package as claimed in claim 1 wherein the number of recesses in the tray are within a range of from 2 to 12.

17. A method for packaging meat in a meat product package for displaying in an arcuate arrangement a plurality of elongated, free ended, sausage-shaped meat products which have been processed prior to packaging such that the meat products normally maintain a substantially straight shape, said method comprising the steps of: providing a tray and a plurality of said elongated, free ended, sausage-shaped, processed meat products, each meat product having a longitudinal axis, the tray having a plurality of elongated recesses, each recess having a longitudinal arcuate configuration and each recess being suitably sized to receive the normally substantially straight meat product wherein after it has been bent, and to hold the normally substantially straight meat product in the arcuate configuration of the recess under tension, each recess having a bottom portion, side portions and end portions, the bottom and side portions extending substantially parallel to the product longitudinal axis, and the side and end portions having overformed edges, said overformed edges extending beyond the arcuate configuration of the recess to maintain the sausage-shaped meat product in the arcuate configuration under tension within the recess for storage and display; arranging the normally substantially straight processed meat products in an arcuate configuration under tension to conform to the elongated arcuate recesses and positioning the tensioned and arcuately configured meat products within the recesses such that the overformed edges maintain the meat products in the arcuate configuration under tension.

* * * * *